US006583785B2

(12) United States Patent
Yeh

(10) Patent No.: US 6,583,785 B2
(45) Date of Patent: Jun. 24, 2003

(54) VARIABLE CLOCK RATE DISPLAY DEVICE

(75) Inventor: Chun Lin Yeh, Hsinchu (TW)

(73) Assignee: Integrated Technology Express Inc., Hsinchu (TW)

( * ) Notice: Subject to any disclaimer, the term of this patent is extended or adjusted under 35 U.S.C. 154(b) by 191 days.

(21) Appl. No.: 09/777,247

(22) Filed: Feb. 5, 2001

(65) Prior Publication Data

US 2002/0093478 A1 Jul. 18, 2002

(30) Foreign Application Priority Data

Jan. 12, 2001 (TW) ..... 90100699 A

(51) Int. Cl.[7] ..... G09G 5/00

(52) U.S. Cl. ..... 345/204; 345/99; 345/213

(58) Field of Search ..... 345/204, 213, 345/99, 100, 534, 531, 547, 574, 554; 348/510, 536, 537

(56) References Cited

U.S. PATENT DOCUMENTS 5,745,106 A * 4/1998 Chandavarkar ..... 331/57
5,796,391 A * 8/1998 Chiu et al. ..... 340/7.55
6,020,904 A * 2/2000 Clark ..... 345/554

* cited by examiner

*Primary Examiner*—Chanh Nguyen

(57) ABSTRACT

A variable clock rate device and a method of operating the device. When the display device is first initialized, a pixel clock and a memory read clock are set to the largest values. If the CPU reads from the memory area, the frequency of the pixel clock and the memory read clock is adjusted according to the frequency of the CPU update on-screen memory and the variation of the CPU change on-screen memory block. On the contrary, if the CPU does not initiate any updating, the pixel clock and the memory read clock are tuned down to the smallest possible values to conserve electricity.

3 Claims, 1 Drawing Sheet

VARIABLE CLOCK RATE DISPLAY DEVICE

CROSS-REFERENCE TO RELATED APPLICATION

This application claims the priority benefit of Taiwan application serial No. 90100699, filed Jan. 12, 2001.

BACKGROUND OF THE INVENTION

1. Field of Invention

The present invention relates to a display device and corresponding method of operating the display device. More particularly, the present invention relates to a display device whose clock rate can be adjusted according to the actual operating state so that power consumption is reduced.

2. Description of Related Art

Due to the rapid development in Internet technologies, computer use is becoming more and more popular. The type of data that are shuttled between users includes document data as well as voice and image data. With so much information transferred through various media, transmission rates and processing efficiency have become important aspects of computer system research. Amongst the various types of transmissions, image data transmission normally requires the largest data volume. Image data are normally displayed on a display device (for example, a liquid crystal display (LCD) or a cathode ray tube (CRT)). In general, the display controller of a display device has a pixel clock pulsing at a fixed frequency. Image signals are displayed on a screen according to a fixed clock rate.

In practice, image signals need not be displayed using the same clock rate at all times. For example, a user may have to go over many scenes in succession at the beginning and hence a rapid switching of images is desirable. If the clock rate is too low, the user may have to wait a long time. On the contrary, once a user has stepped into a special program execution, identical scenes or scenes with little variation are often displayed. Under such circumstances, power consumed by the display controller and any associated external memory is wasted if a high clock rate is maintained. Therefore, not only is the cost of operation high, but the working life of the equipment is also shortened.

SUMMARY OF THE INVENTION

Accordingly, one object of the present invention is to provide a variable clock rate display device and corresponding method of operating the device. The device is capable of finding an optimal clock frequency according to the actual state of the computer system so that the user's demands are met while power consumption is reduced.

To achieve these and other advantages and in accordance with the purpose of the invention, as embodied and broadly described herein, the invention provides a variable clock rate display device. The display device includes a decision block, a frequency change block, a first multiplexer, a second multiplexer, a memory unit, a memory controller, a display controller and a display panel.

The decision block receives a CPU write address signal, an on-screen start address signal and an on-screen end address signal to determine if a CPU update on-screen mean data and a change on-screen mean area need to be transferred to the frequency change block. The frequency change block receives the CPU update on-screen mean data and a change on-screen mean area, together with a synchronous signal for submitting a clock set signal. The first multiplexer receives the clock set signal to determine a pixel clock signal and then outputs a corresponding clock set signal. The second multiplexer receives the corresponding clock set signal to determine a memory read clock signal. The memory unit holds a piece of data. The memory controller receives the memory read clock signal and retrieves the data from the memory unit. The memory controller then outputs a memory read data clock pulse. The display controller receives the memory read data clock pulse and the pixel clock signal to output an on-screen data signal and a corresponding pixel clock signal. The display panel receives the on-screen data signal and the corresponding pixel clock signal to produce an image. The display panel can be a liquid crystal display (LCD) or a cathode ray tube (CRT), for example.

This invention also provides a method of adjusting the clock rate of a display device. First, a pixel clock and a memory read clock are set to the largest values when the display device is initialized. If the CPU reads from the memory area, the frequency of the pixel clock and the memory read clock is adjusted according to the frequency of the CPU update on-screen memory and the variation of the CPU change on-screen memory block. On the other hand, if the CPU does not initiate any updating, the pixel clock and the memory read clock are tuned down to their minimum values.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
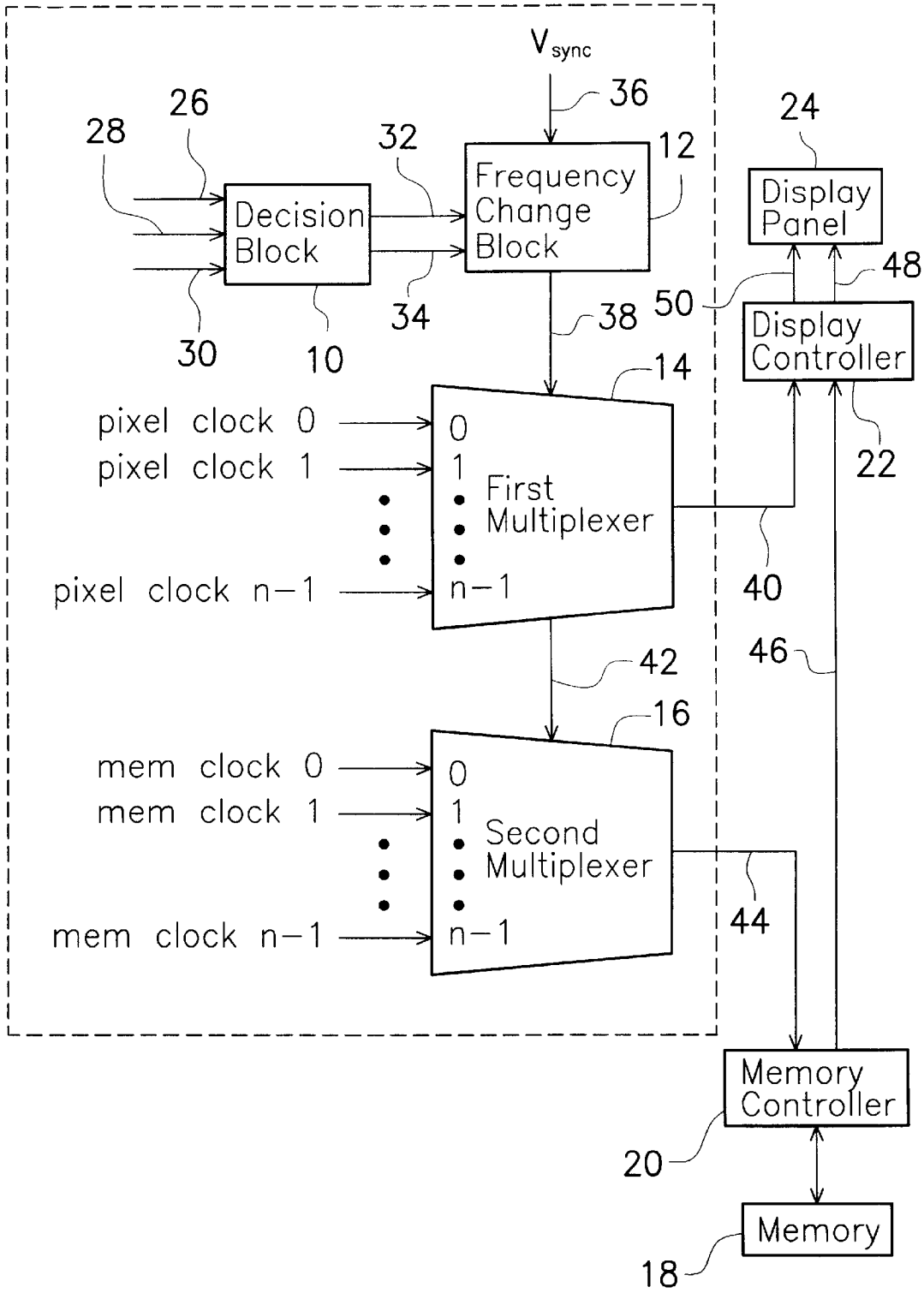
FIG. 1 is a schematic diagram showing a variable clock rate display device according to one preferred embodiment of this invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic diagram showing a variable clock rate display device according to one preferred embodiment of this invention.

As shown in FIG. 1, the variable clock rate display device includes a decision block 10, a frequency change block 12, a first multiplexer 14, a second multiplexer 16, a memory unit 18, a memory controller 20, a display controller 22 and a display panel 24.

The decision block 10 receives a CPU write address signal 26, an on-screen start address signal 28 and an on-screen end address signal 30. The size of the image block to be used is determined so that the CPU update on-screen mean data 32 and the change on-screen mean area 34 are sent to the frequency change block 12.

The frequency change block 12 generates a user clock set signal 38 according to the CPU update on-screen mean data 32 and the change on-screen mean area 34, together with a synchronous signal (Vsync) 36. The clock set signal 38 is sent to the first multiplexer 14. The first multiplexer 14 also picks up a plurality of different pixel clock signals (pixel clock 0~pixel clock n−1). According to the clock set signal 38, one of the pixel clock signals (pixel clock 0~pixel clock n−1) is selected to produce a pixel clock output 40. In the meantime, a corresponding clock set signal 42 is sent to the second multiplexer 16. The second multiplexer 16 also picks up a plurality of different memory clock signals (mem clock 0~mem clock n−1). According to the corresponding clock set signal 42, one of the memory clock signals (mem clock 0~mem clock n−1) is selected to produce a memory read clock output 44.

In addition, data are stored inside the memory unit 18. After reading the memory read clock signal 44, the memory controller 22 retrieves corresponding data from the memory unit 18 and then sends out a memory read data 46 to the display controller 22. The display controller 22 receives the memory read data 46 and the pixel clock signal 40 and generates an on-screen data signal 48 and a corresponding pixel clock signal 50 to the display panel 24. Ultimately, an image is produced on the display panel 24. The display panel can be liquid crystal display (LCD) or a cathode ray tube (CRT), for example.

The decision block 10 controls the processing of fast, slow and static pictures through the display controller 22 based on the frequency of access of the CPU update on-screen memory or the change on-screen memory area. Therefore, the pixel clock signal 40 and the memory read clock 44 generated by the first multiplexer 14 and the second multiplexer 16 are high-speed, medium-speed and slow-speed respectively. Hence, power consumption can be lowered when no updating is required by the system and an optimal state is always maintained without too much waiting for updating.

This invention also provides a method of adjusting the clock rate of a display device. When the display device is first initialized, a pixel clock and a memory read clock are set to the largest values. The largest values are required because rapid switching and a lot of preparatory work are anticipated. When the CPU reads from the memory area, the frequency of the pixel clock and the memory read clock is adjusted according to the frequency of the CPU update on-screen memory and the variation of the CPU change on-screen memory block. On the contrary, if the CPU does not initiate any updating, either identical images or images with very little variation are required on screen. Hence, the pixel clock and the memory read clock are tuned down to their respective minimum values to conserve electricity.

In conclusion, the variable clock rate display device is able to pinpoint the frequency of the CPU update on-screen memory and the variation of the CPU change on-screen memory block for proper adjustment of the pixel clock and the memory read clock. Hence, besides maintaining an optimum state for the user, power consumption is also reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display device having a variable clock rate, comprising:

a decision block for determining the output of the CPU update on-screen mean data and the change on-screen mean area according to a CPU write address signal, an on-screen initial address signal and an on-screen end address signal;

a frequency change block for receiving the CPU update on-screen mean data, the change on-screen mean area, together with a synchronous signal for transmitting a clock set signal;

a first multiplexer for receiving the clock set signal to produce a pixel clock signal output and submitting a corresponding clock set signal;

a second multiplexer for receiving the corresponding clock set signal to produce a memory read clock signal output;

a memory unit for holding data;

a memory controller for receiving the memory read clock signal and reading corresponding data from the memory unit, and then submitting memory read data;

a display controller for receiving the memory read data and the pixel clock signal and generating an on-screen data signal and a corresponding pixel clock signal output; and a display panel for receiving the on-screen data signal and the corresponding pixel clock signal to produce an image.

2. The device of claim 1, wherein the display panel includes a liquid crystal display (LCD) device.

3. The device of claim 1, wherein the display panel includes a cathode ray tube (CRT).

* * * * *